United States Patent [19]

Hudspeth et al.

[11] Patent Number: 4,533,884

[45] Date of Patent: Aug. 6, 1985

[54] COAXIAL LINE TO WAVEGUIDE ADAPTER

[75] Inventors: Thomas Hudspeth, Malibu; Harmon H. Keeling, Lake Isabella, both of Calif.

[73] Assignee: Hughes Aircraft Company, El Segundo, Calif.

[21] Appl. No.: 468,825

[22] Filed: Feb. 23, 1983

[51] Int. Cl.[3] ..... H01P 5/103

[52] U.S. Cl. ..... 333/26; 333/33; 333/21 R; 333/245

[58] Field of Search ..... 333/26, 21 R, 243, 244, 333/248, 245; 343/789

[56] References Cited

U.S. PATENT DOCUMENTS

| | | | |
|---|---|---|---|
| 3,239,838 | 3/1966 | Kelleher | 343/789 |
| 3,496,492 | 2/1970 | Kurzl et al. | 333/116 |
| 3,654,571 | 4/1972 | Rucker et al. | 333/21 R |
| 3,942,138 | 3/1976 | Schaedla | 333/33 X |
| 4,011,566 | 3/1977 | Honda | 333/21 R X |

*Primary Examiner*—Eugene R. LaRoche
*Assistant Examiner*—Benny T. Lee
*Attorney, Agent, or Firm*—W. J. Benman, Jr.; A. W. Karambelas

[57] ABSTRACT

An adapter of a coaxial transmission line to a waveguide is provided for connecting the waveguide to a microwave circuit of coaxial lines which is formed by milling out the lines within a plate of a soft metal. The coaxial transmission lines are of rectangular, preferably square, cross-section with the outer conductors thereof being provided by the walls of the channel. The inner conductors of the coaxial lines are rod-shaped, the inner conductors also being of rectangular or square cross-section. An aperture is provided in an outer wall of the coaxial line. A stem connects with an inner conductor and passes through the aperture to extend outwardly therefrom. A waveguide is positioned with its propagation axis parallel to the stem, the waveguide enclosing the stem and being secured to the outer walls of the coaxial lines. The stem is placed adjacent the inner wall of the waveguide, but spaced apart therefrom to support a transverse electromagnetic wave. A dipole element of planar shape extends transversely of the waveguide and is secured at an edge thereof to the terminus of the stem. The dipole element launches a propagating mode of wave within the waveguide while receiving its energization from the transverse electromagnetic wave propagating along the coaxial line and along the stem.

6 Claims, 3 Drawing Figures

COAXIAL LINE TO WAVEGUIDE ADAPTER

BACKGROUND OF THE INVENTION

This invention relates to coaxial transmission lines constructed by machining channels within an electrically conducting plate and, more particularly, to an adapter permitting the connection of either a coaxial transmission line or a waveguide with a mode launcher to a port in the plane of the plate.

Cross-reference is hereby made to three copending applications pertaining to microwave systems assigned to the same assignee; "Square Conductor Coaxial Coupler" invented by T. Hudspeth, R. V. Basil and H. H. Keeling, Ser. No. 468,826, filed on Feb. 23, 1983, "Coaxial Transmission Line Crossing" invented by T. Hudspeth and H. H. Keeling, Ser. No. 468,827, filed on Feb. 23, 1983, and "Ferrite Modulator Assembly For Beacon Tracking System" invented by T. Hudspeth, H. S. Rosen and F. Steinberg, Ser. No. 469,870, filed on Feb. 25, 1983. These applications are hereby incorporated by reference in their entirety.

Coaxial transmission lines fine wide use in microwave circuitry as they support a TEM (transverse electromagnetic) wave for the communication of the microwave energy over a wide bandwidth. A particular use of the coaxial transmission lines is found in the construction of satellites which orbit the earth for communication of information among stations on the surface of the earth. Such satellites include antennas which point towards the earth stations so as to enable the satellite to receive and to retransmit messages from station to station.

One function of the microwave circuitry is the processing of signals received from the antennas. A particular function, by way of example, is the development of signals for the pointing of the antennas in two dimensions, namely, azimuth and elevation. To ensure a minimal weight to the microwave circuitry, and a maximum of reliability, it is advangeous to form the circuits by milling out channels in a metallic plate. Preferably, a soft, light weight metal, such as aluminum, is utilized since the softness facilitates the milling, while the light weight reduces the overall weight of the satellite. The aluminum readily conducts electricity and, accordingly, the side walls of the channels serve as side walls of coaxial lines. The inner, or center, conductors of the coaxial lines are formed of rods which are supported by insulators within the channels, the insulators serving to space the rods equidistantly from the side wall, or outer conductors, of the coaxial lines. In one advantageous embodiment of such microwave circuitry, the inner and outer conductors are both provided with a cross-sectional shape which is square.

A problem arises with respect to the coupling of the microwave energy from the antenna to the circuitry of the plate. Typically, the antenna is located at a distance from the plate and a waveguide connection is made between the antenna and the microwave circuitry of the plate. Thus, it is necessary to provide for a transition between the coaxial structure of the transmission lines within the plate and the ports of the antenna. For example, the antenna may be connected to a monopulse feed, the ports of which are connected by the waveguides to the microwave circuitry.

However, in addition to the necessary transition between the waveguide and the coaxial transmission lines of the microwave circuitry, it is also advantageous to provide for an alternative coaxial connection to the microwave circuitry at the site of the waveguide. This permits for check-out of the microwave circuitry before connection of the waveguides thereto. Thus, as may be readily visualized, it becomes desirable to place either a waveguide, extending normally from the plane of the plate at the site of transition, or a coaxial connector for the connection with a flexible cable upstanding from the plate at the site of the transition. Accordingly, the foregoing situation requires a transition which will admit for both the connection of a waveguide as well as the connection of a coaxial fitting or a flexible coaxial cable.

SUMMARY OF THE INVENTION

The foregoing problem is overcome, and other advantages are provided by a transition, or adapter, between the square coaxial transmission lines of the microwave circuitry, milled in the plate, for connection with a waveguide or flexible coaxial cable.

In accordance with the invention, a circular aperture is placed either in the bottom section of the plate, itself, or in a cover of the plate. The cover serves to close off the tops of the channels of the coaxial lines. An inner conductor is directed perpendicularly to the plate through the circular aperture and makes contact with an inner conductor of the square coaxial line. The inner conductor of the transition and the diameter of the aperture are selected to mate with the corresponding dimensions of the connecting element of a flexible coaxial cable.

In accordance with an important feature of the invention, the inner conductor of the transition can be unscrewed from its mount at the inner conductor of the square coaxial transmission line and be replaced with a mode launcher which is threadily secured to the inner conductor of the square coaxial transmission line. In addition, the waveguide is secured by bolts and oversized holes to the plate, or the cover, with the mode launcher extending inside the waveguide. The oversized holes permit the alignment of the waveguide to provide for a relatively small space between a broad wall of the waveguide and a stem portion of the mode launcher. This is so that the stem portion can conduct a TEM wave from the square coaxial transmission line into the waveguide to a distance of approximately three-eights of a wavelength whereupon a dipole section of the mode launcher converts the TEM wave to a mode suitable for transmission along the waveguide. The adjustment of the position of the waveguide relative to the stem of the mode launcher provides for an impedance of the mode launcher section which matches that of the square coaxial transmission line so as to minimize reflections and maximize the coupling of power at the transition. The dipole portion of the mode launcher is in the form of a plate oriented normally to the axis of the waveguide and fixed at an edge portion thereof to the foregoing stem of the mode launcher. The space between the dipole and the end of the waveguide provides for a reactive component to the impedance which, in combination with the radiating characteristics of the dipole, provides for the launching of the wave along the waveguide and the matching of the impedance of the dipole to that of the stem over a wide frequency range.

BRIEF DESCRIPTION OF THE DRAWINGS

The foregoing aspects and other features of the invention are explained in the following description, taken in connection with the accompanying drawings wherein.

DETAILED DESCRIPTION

Figure 1:
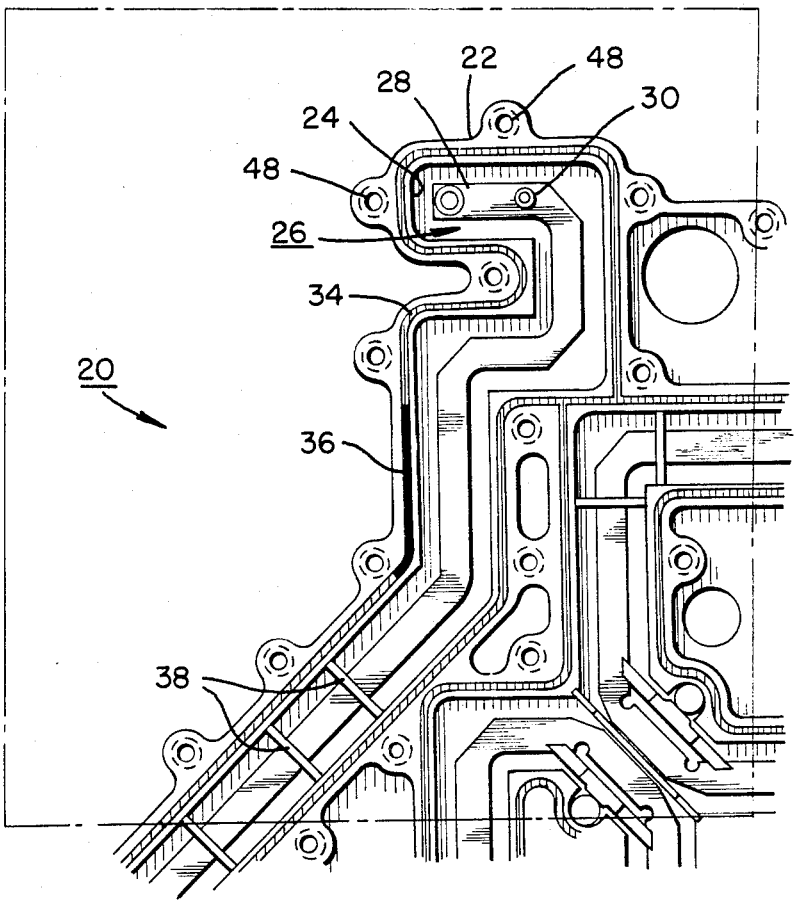
FIG. 1 is a plan view of a portion of a microwave circuit milled in a base plate with a cover plate thereof being removed to show the inner conductor of the coaxial transmission line supported by an insulated bushing relative to the side walls of a channel.
Figure 2:
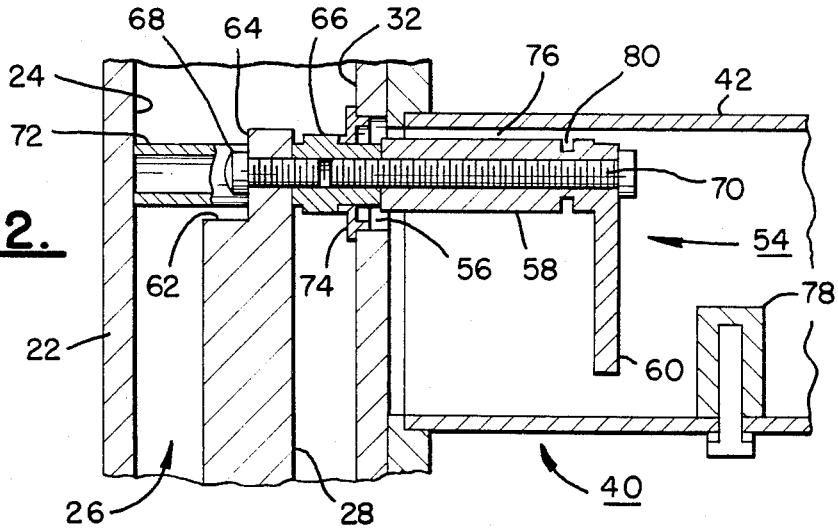
FIG. 2 is a sectional view through the end of the inner conductor of FIG. 1, the view also showing the emplacement of the cover plate and a portion of a waveguide secured thereto, the waveguide and a mode launcher of the invention being shown in section.
Figure 3:
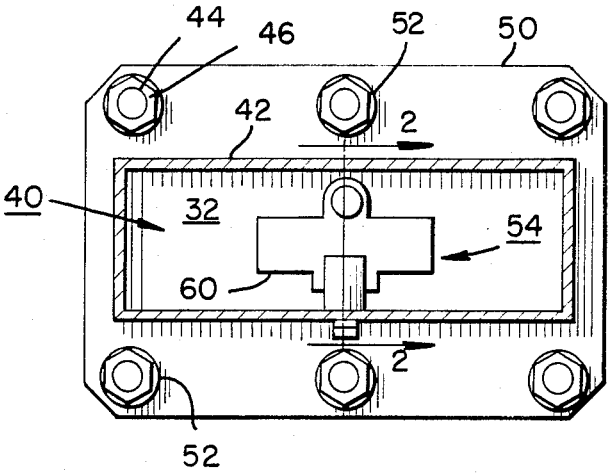
FIG. 3 is a top view of the mode launcher as viewed along the axis of the waveguide of the FIG. 2.

The portion of a microwave circuit 20 is disclosed in FIGS. 1-3, the circuits 20 comprising a base plate 22 having channels 24 machined therein. The plate 22 is constructed of a light weight, electrically conducting material, such as aluminum. Thereby, the interior walls of the channels 24 can serve as the outer conductors of a coaxial line 26. The inner conductor is formed of a rod 28 which is supported by insulating bushings 30, the bushings 30 positioning the rod 28 between the top and the bottom walls of the coaxial line 26. The cover 32 (deleted in FIG. 1, but shown in FIGS. 2 and 3) is formed of the same material, aluminum, as is the plate 22, and serves the function of closing off the open channels 24 so as to complete the structure of the coaxial lines 26. Grooves 34 are spaced back from the openings of the channels 24 to receive a gasket 36 of any well-known, commercially-available rubber containing metallic particles. Tightening of the cover 32 against the plate 22 compresses the gaskets 36 as to provide a seal against the emission of microwave energy. Insulating spacers 38 may also be positioned about the rod 28 for locating it within a channel 24. Both the cross-section of a channel 24 and the cross-section of the rod 28 are rectangular shape, and preferably a square shape.

In accordance with the invention, an adapter 40 (shown in FIGS. 2 and 3) comprises a waveguide 42 having its longitudinal axis normal to the plane of the plate 22. The waveguide 42 is secured by threaded studs 44 and nuts 46 to the cover 32, the latter being secured by bolts (not shown) to threaded holes 48 disposed alongside a channel 24 of FIG. 1. The waveguide 42 includes a flange 50 having oversized holes 52 for receiving the studs 44, the oversized holes 52 permitting a precise positioning of the waveguide 42 for reasons which will become apparent. A mode launcher 54 extends through a circular aperture 56 in the cover 32 to enter the end portion of the waveguide 42. The launcher 54 comprises a stem 58 and a dipole element 60 which extends transversely to the stem 58 at an outer end thereof.

At the site of the adapter 40, the square-shaped rod 28 is reduced in thickness by a step 62 leaving a tongue 64 of rectangular cross-section. The stem 58 is secured to the tongue 64 by means of a threaded coupling 66, a screw 68 extending from the tongue 64 into the coupling 66 and a screw 70 extending through the stem 58 and into the coupling 66 in the opposite direction from the screw 68.

An insulating dielectric, cylindrically-shaped bushing 72 stands on the bottom of a channel 24 at the site of the adapter 40 to support the head of the screw 68 and the tongue 64. An insulating dielectric sleeve 74 sets within the aperture 56 and surrounds the coupling 66 so as to steady the coupling 66 and the stem 58. The oversized holes 52 in the flange 50 of the waveguide 42 are used to position the waveguide 42 so as to provide a narrow space, typically on the order of 0.031 inches (at a design frequency of 4 Gigahertz), between a tangent plane to the stem 58 and an inner wall of the waveguide 42. The narrow spacing provides for the structure of a transmission line 76 having a 50 ohm impedance for the propagation of a TEM wave along the stem 58 up to the dipole element 60. The foregoing spacing in the line 76 is less than approximately 5% of a quarter wavelength to ensure that there is no significant amount of radiation into the waveguide until the TEM wave reaches the dipole element 60.

In the operation of the mode launcher 54, the lines of the electric field extend between the stem 58 and the wall of the waveguide 42. The dipole element 60 loads the stem 58 so as to terminate the line 76 in the 50 ohm impedance, and also provides for the orientation of the electric and magnetic field which serve as a source for the excitation of the waveguide modes. The distance between the dipole element 60 and the end of the waveguide, at the cover 32, is selected to be in the range of between one-eighth and one-quarter wavelength of the waveguide wavelength. The tuning post 78 is set further down the waveguide, approximately one-eighth of the guide wavelength for tuning the reactive components of the waveguide structure. The exact dimensions and spacing of the foregoing elements is a matter of design choice and, as is well known, can be determined experimentally.

By way of further structures useful in the tuning of the launcher 54, a circumferential groove 80 may be set into the stem 58 near the outer terminus thereof. Such a groove provides an inductive reactance to the TEM wave traveling along the stem 58 to match the impedance of the dipole element 60.

In accordance with a further feature of the invention, the waveguide 42 may be removed by loosening the nuts 46 and the stem 58 may be removed by loosening the screw 70. Thereupon, the remaining structure of the coupling 66 and the aperture 56 is appropriately dimensioned to receive a coaxial adapter (not shown) which connects to a standard form of coaxial connector such as the commercially-available type APC-7 manufactured by Amphenol of Danbury, Connecticut. Thereby, the microwave circuit 20 can be tested by use of standard test equipment (not shown) coupled by a flexible cable and the foregoing connector to the site of the adapter 40.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An adapter of a coaxial transmission line to a waveguide comprising:

(a) a microwave circuit disposed within a plate of electrically conductive material, said circuit including coaxial transmission lines formed of rectangular channels cut into said plate and rod-shaped inner conductors of rectangular cross-section;

(b) a cover of electrically conductive material set on said plate and closing off said channels to complete the outer conductor of said coaxial transmission lines;

(c) an aperture in the outer conductor adjacent to one of said transmission lines;

(d) a waveguide located at said aperture and secured to the outer conductor of said one transmission line;

(e) a mode launcher extending from the inner conductor of said one transmission line through said aperture and into said waveguide to couple said inner conductor via said aperture to said waveguide; and (f) said mode launcher comprising a stem passing adjacent an inner wall of said waveguide but spaced apart therefrom for transporting a transverse electromagnetic wave, and wherein said mode launcher includes a dipole element of planar shape disposed within said waveguide and normal to the propagation axis of said waveguide, said dipole element being supported at an edge thereof by a terminus of said stem.

2. An adapter according to claim 1 further comprising a coupling for securing said stem to an end portion of said inner conductor.

3. An adapter according to claim 2 wherein the end portion of said inner conductor is stepped to provide a tongue of reduced cross-sectional dimensions.

4. An adapter according to claim 3 wherein said coupling is secured by a screw to said tongue.

5. An adapter according to claim 4 further comprising a tuning post extending from an inner wall of said waveguide in a plane parallel to the plane of said dipole element and spaced at a greater distance from an end of said waveguide than said dipole element.

6. An adapter according to claim 5 wherein said waveguide has a broad wall and a narrow wall defining a rectangular cross-section of a long dimension and a short dimension, and wherein said dipole element extends over a major portion of said short dimension and over a minor portion of said long dimension.

* * * * *